United States Patent [19]

Girard

[11] Patent Number: 4,873,528

[45] Date of Patent: Oct. 10, 1989

[54] DEVICE FOR ENERGIZING A NON-ECCENTRIC IN THE WIDE SIDE OF A WAVEGUIDE, AND A SLOTTED ANTENNA COMPRISING SUCH A DEVICE

[75] Inventor: Bernard Girard, Paris, France

[73] Assignee: Thomson-CSF, Paris, France

[21] Appl. No.: 472,259

[22] Filed: Mar. 2, 1983

[30] Foreign Application Priority Data

Mar. 26, 1982 [FR] France ..... 82 05248

[51] Int. Cl.[4] ..... H01Q 13/10

[52] U.S. Cl. ..... 343/770

[58] Field of Search ..... 343/767, 769, 770, 783, 343/779, 782, 762, 775, 772

[56] References Cited

U.S. PATENT DOCUMENTS 2,807,018 9/1957 Woodward, Jr. ..... 343/770

3,015,100 12/1961 Rotman ..... 343/772

*Primary Examiner*—Theodore M. Blum

*Attorney, Agent, or Firm*—Cushman, Darby & Cushman

[57] ABSTRACT

A rectangular waveguide with one wide side pierced by slots centered on the longitudinal axis of symmetry. The other wide side includes a ridge having a metallic ribbon with two teeth on its edge each of which is symmetrical with respect to an axis and facing a slot to be energized. The slots are λo/2 long and are 0.7 λo apart where λo is the wave length in air. The two axes of symmetry of the teeth are paralell and λg/4 apart, where λg is the wave length in the guide.

6 Claims, 2 Drawing Sheets

Figure 2:
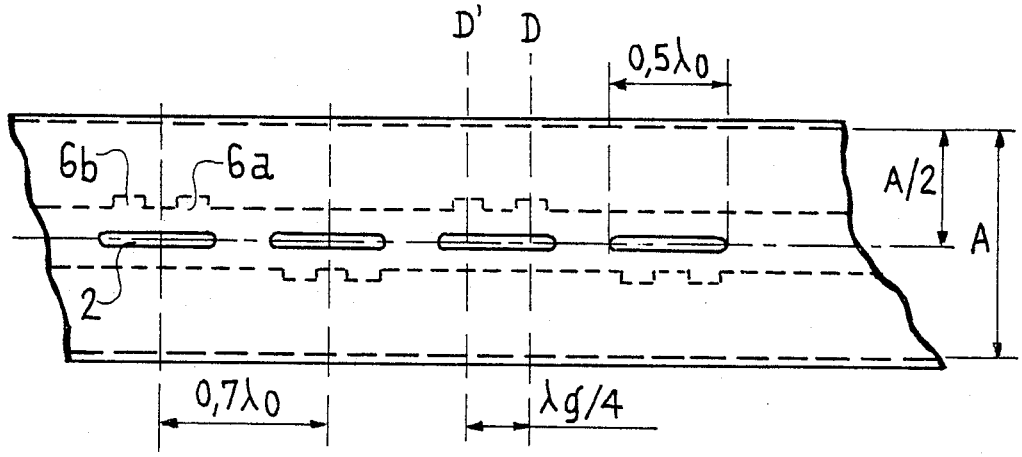

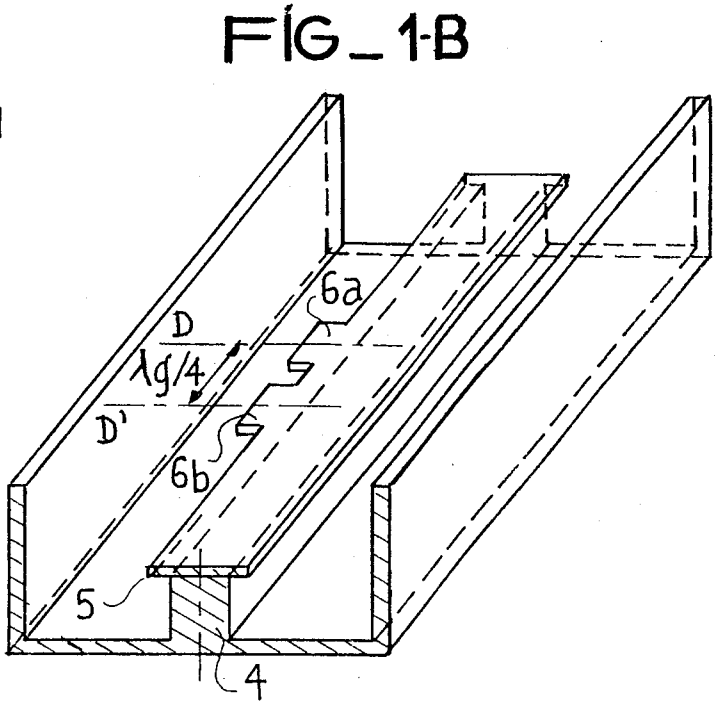
FIG_1-B
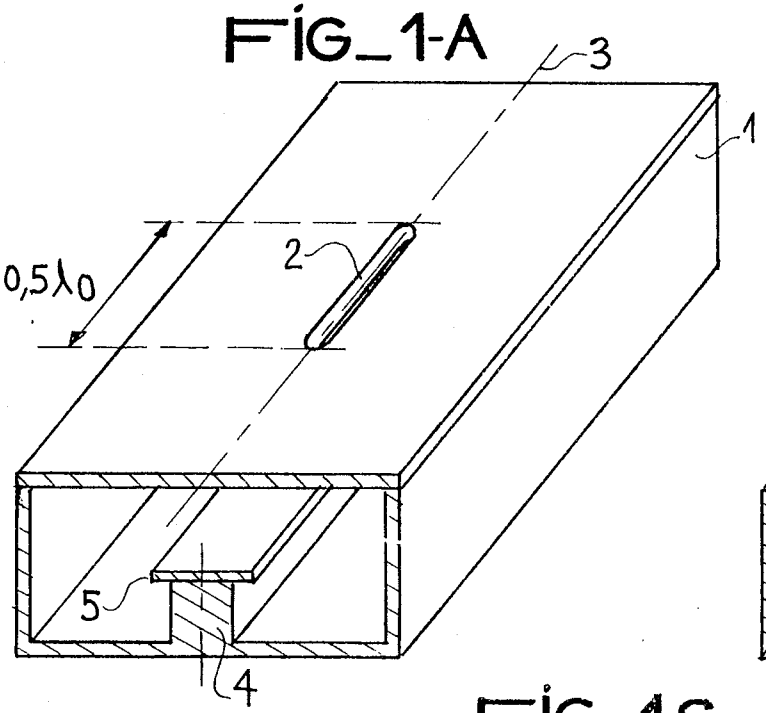
FIG_1-A
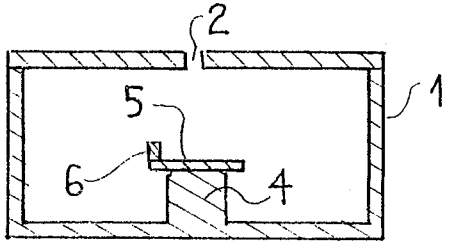
FIG_1-C

DEVICE FOR ENERGIZING A NON-ECCENTRIC IN THE WIDE SIDE OF A WAVEGUIDE, AND A SLOTTED ANTENNA COMPRISING SUCH A DEVICE

The present invention relates to a device for energizing a non-eccentric slot in the wide side of a waveguide, and to a slotted antenna energized by such a device.

In a slotted antenna, and more especially in an electronic scanning antenna, when a slot is cut in the wide side of a waveguide transmitting a wave in the $TE_{01}$ mode, in most cases the slot is eccentric with respect to the longitudinal axis of the said wide side in order to cut the current lines. As it is not arranged in an equipotential zone, since the axis of the wide side is contained in the plane of symmetry of the electric field configuration of the guide, it can radiate. This is the solution adopted in two types of slotted antenna:

In the antennas of the first type waveguides are juxtaposed which have eccentric slots in their wide side. Because of the eccentricity of the slots, this technique gives rise to grating lobes having a high level, which are troublesome in an electronic scanning antenna when the beam is disaimed. Furthermore such antennas are relatively bulky.

The antennas of the second type are formed by guides which are partly or wholly filled with dielectric and whose wide side is provided with eccentric slots. In the case of guides completely filled with dielectric, the width of the guide can be reduced in a ratio $1/\epsilon_R$ in which $\epsilon_R$ is the dielectric constant of the material used.

Such an antenna offers several disadvantages among which are the existence of important losses and of grating lobes due to the eccentricity of the slots and an operation with a high sensibility to temperature and vibrations because of the difficulty of keeping good contact between the dielectric and the guide metal.

There are two other types of slotted antenna:

Antennas formed by juxtaposed guides whose small side is provided with centred, sloped slots. Such a technique generates a cross polarization wave.

Antennas formed by juxtaposed guides with centred slots in their wide side which are energized by a resonant pillar or iris. This technique offers two disadvantages: an antenna of this type is difficult to embody and the guides are bulky.

The present invention makes it possible to correct the above-mentioned disadvantages and also relates to an antenna with one or more slots centred on the longitudinal axis of the wide side of a guide.

The slotted antenna according to the invention has a radiation diagram which is optimized by the suppression of grating globes, is very efficient and has small losses.

The slotted antenna in accordance with the invention is of small size, is easy to embody and is not expensive.

In accordance with the invention, the device for energizing an antenna formed by a rectangular waveguide whose first wide side is pierced by one or more slots along its longitudinal axis of symmetry and whose second wide side is provided in its middle with a ridge bearing a metallic ribbon parallel to the wide sides of the guide comprises for each slot, first and second thin metallic teeth of identical shape symmetrical with respect to an axis, the repective axes of symmetry of the two teeth energizing a slot being parallel and the teeth being arranged side by side on the edge of the metallic ribbon and facing the slot to be energized.

The present invention will be better understood by reading the following detailed description with reference to the attached figures which show:

FIG. 1A, a perspective view of a slotted antenna in accordance with the invention, FIG. 1B, a longitudinal sectional view of the antenna of FIG. 1A showing an embodiment of its energizing device;

FIG. 1C, a cross-sectional view of the antenna of FIG. 1A showing another embodiment of its energizing device;

FIG. 2, a view from above of an antenna with several slots energized by a device as in FIG. 1B.

The slotted antenna consists, in a known way, of a rectangular waveguide 1 of whose wide sides is pierced by one or more elongated slots 2. Waveguide 1 operates in a frequency band whose cut-off frequency is Fc.

The same references are used in the various figures to designate identical elements or elements having the same function.

Let $\lambda g$ be the wavelength in the guide and $\lambda o$ the wavelength in air.

Slot 2, which is operating at resonance, is $\lambda o/2$ long.

In order to radiate, slot 2 must not be in an equipotential zone. As a result, if it is placed in the longitudinal axis 3 of the wide side of guide 1, the electric field distribution must be made assymmetrical at slot 2 for it to be able to radiate.

This can be obtained by various means: A first embodiment of the device according to the invention for energizing such non-eccentric slots is shown in FIG. 1A and 1B which represent respectively a perspective view and a sectional view of a slotted antenna in accordance with the invention.

In this non-limitative example the inside wall of the wide guide side, which is opposite the side with slots 2, is fitted in its centre with a ridge 4 bearing a metallic ribbon 5 parallel to the wide sides.

The device energizing slot 2 appears clearly in FIG. 1B which shows the antenna of FIG. 1A from which the wide side with the slots has been removed.

Metallic ribbon 5 has, on one longitudinal edge at each slot 2, discontinuities formed by two teeth, *6a* and *6b*, of the same shape, each of the two teeth *6a*, *6b* being respectively symmetrical with respect to a transverse axis D, D′ parallel to the wide sides of guide 1. For each slot the distance between the two transverse axes of symmetry D, D′ of the energizing device is fixed at $\lambda g/4$ in which $\lambda g$ is the wavelength in the guide. The length of teeth *6a* and *6b* fixes the conductance. When several slots 2 have been cut in the longitudinal axis 3 of the wide side of waveguide 1, spaced at more than $0.7\lambda o$ (centre to centre) as shown in FIG. 2 in order to avoid grating lobes, the energizing devices for two slots in succession, each formed by two teeth, *6a* and *6b*, are placed on each longitudinal side of metallic ribbon 5 in a staggered arrangement.

The two teeth, *6a* and *6b*, forming the energizing device for one slot may have different shapes but always have an axis of symmetry D, D′ respectively. They are shown with a rectangular surface in FIGS. 1B and 2 but they may also be trapezoidal or triangular for example.

Hence, for X band operation with a cut off frequency of 6.5 GHz in the $TE_{01}$ mode, the guide has a rectangular section 15 mm by 10.16 mm. The two teeth, rectangular for example, are of a length which may vary from 1 to 5 mm as a function of the conductance value required, the constant width being 2 mm and the thickness 1 mm at the most.

The standardized conductance of a slot, measured in these conditions, is between 0.05 and 0.9. The conductance desired can be obtained by adjusting an identical fashion in the length of each of the two teeth, 6a and 6b, corresponding to the slot 2 concerned.

FIG. 1C is a cross-sectional view of the antenna of FIG. 1A and shows another embodiment of the device for energizing a slot 2. Teeth **6*a* and 6*b* are also placed on the same longitudinal edge of metallic ribbon 5 fitted on ridge 4 but are perpendicular to the wide sides of waveguide 1**.

The arrangement, the dimensions and the symmetrical shape of teeth **6*a* and 6*b* with respect to an axis, the two axes of symmetry D, D' of two teeth 6*a*, 6*b* energizing the same slot 2 being $\lambda g/4$ apart, satisfy the same conditions as when they are parallel to the wide sides of guide 1 (FIG. 1B**).

Metallic ribbon 5, provided with teeth **6*a* and 6*b* can be machined at the same time as guide 1 and ridge 4. In this case, the inside angles of the base of rectangular teeth are slightly rounded but this is not a disadvantage for the energizing of slots 2**.

Metallic ribbon 5 provided with teeth **6*a* and 6*b* can also be made separately from ridged guide 1. It is then fixed to ridge 4** in the guide horizontally with respect to the wide sides of the guide by the "Dip brazing" technique for example.

A slotted antenna has thus been made with a radiation diagram optimized by suppression of the grating lobes, with excellent efficiency, low loss, small size, low production cost and operation little sensitive to temperature variations and to vibrations.

The present invention is applicable to electronic scanning antennas.

I claim:

1. A device for energizing an antenna formed by a rectangular waveguide comprising a first wide side pierced by at least one slot extending along a longitudinal axis of symmetry and a second wide side provided with a ridge bearing a metallic ribbon parallel to the wide sides of the guide and extending along the middle of the second wide side, said ribbon providing for each slot first and second thin metallic teeth of identical shape symmetrical with respect to an axis of symmetry of the two teeth to energize a parallel extending slot with the teeth being arranged side by side on the edge of the metallic ribbon.

2. A device as in claim 1 wherein the respective axes of symmetry of the first and second metallic teeth are $\lambda g/4$ apart, where $\lambda g$ is the wavelength in the guide.

3. A device as in cliam 1 or 2 wherein the respective axes of symmetry of the first and second metallic teeth corresponding to a slot are parallel to the wide sides of the guide.

4. A device for energizing an antenna as in claim 1 or 2 wherein the axes of symmetry of the first and second metallic teeth are perpendicular to the wide sides of the guide.

5. A device as in claim 1 including a plurality of slots the sets of metallic teeth in succession being staggered on one edge and the other of the metallic ribbon.

6. An antenna formed by a rectangular waveguide having a first wide side pierced at intervals of about $0.7\lambda o$ along its longitudinal symmetrical axis by at least one $\lambda o/2$ long slots where $\lambda o$ is the wavelength in air and having a second wide side provided at its center with a ridge bearing a metallic ribbon extending parallel to the wide sides of the guide, said ribbon forming sets of first and second thin metallic teeth of identical shape symmetrical with respect to an axis, the axes of symmetry of the teeth energizing a parallel extending correponding slot and the teeth being arranged side by side on the edge of the metallic ribbon opposite the slot energized.

* * * * *